US010085577B2

(12) United States Patent
Isis et al.

(10) Patent No.: US 10,085,577 B2
(45) Date of Patent: Oct. 2, 2018

(54) PILLOW CONTAINING FLUID DELIVERY SYSTEM

(71) Applicant: H2Pillow L.L.C., Fort Collins, CO (US)

(72) Inventors: Rebecca Jane Isis, Fort Collins, CO (US); Todd Isis, Fort Collins, CO (US)

(73) Assignee: H2Pillow L.L.C., Fort Collins, CO (US)

( * ) Notice: Subject to any disclaimer, the term of this patent is extended or adjusted under 35 U.S.C. 154(b) by 302 days.

(21) Appl. No.: 15/002,125

(22) Filed: Jan. 20, 2016

(65) Prior Publication Data

US 2017/0202376 A1 Jul. 20, 2017

(51) Int. Cl.

| | |
|---|---|
| ***A47C 7/36*** | (2006.01) |
| ***A47G 21/18*** | (2006.01) |
| ***A47G 9/10*** | (2006.01) |
| ***A47C 7/38*** | (2006.01) |
| ***A45F 3/20*** | (2006.01) |
| *A47G 9/00* | (2006.01) |

(52) U.S. Cl.

CPC ..... *A47G 21/185* (2013.01); *A45F 3/20* (2013.01); *A47C 7/383* (2013.01); *A47G 9/1045* (2013.01); *A47G 9/1081* (2013.01); *A47G 2009/008* (2013.01); *A47G 2009/1018* (2013.01)

(58) Field of Classification Search

CPC ..... A47C 7/36; A47G 9/10

USPC ..... 5/636, 644, 654

See application file for complete search history.

(56) References Cited

U.S. PATENT DOCUMENTS

| | | | | |
|---|---|---|---|---|
| 6,109,256 A * | 8/2000 | Sardi | A47C 7/748 | 126/204 |
| 2005/0082316 A1* | 4/2005 | Betkowski | A47C 1/16 | 222/192 |
| 2009/0140005 A1* | 6/2009 | Reichert | A45F 3/20 | 222/95 |

* cited by examiner

*Primary Examiner* — Fredrick C Conley

(74) *Attorney, Agent, or Firm* — Craig R. Miles; CR Miles P.C.

(57) ABSTRACT

A pillow including or adapted to retain a fluid delivery system having at least one fluid reservoir configured to deliver an amount of fluid from at least one reservoir contained within the pillow to the mouth of a user.

15 Claims, 8 Drawing Sheets

PILLOW CONTAINING FLUID DELIVERY SYSTEM

I. TECHNICAL FIELD

Generally, a pillow including or adapted to retain a fluid delivery system having at least one fluid reservoir configured to deliver an amount of fluid from at least one reservoir contained within the pillow to the mouth of a user.

II. BACKGROUND

Pillows may be configured as a casing retaining a soft material such as feathers, down, or other soft material. Fluid delivery systems may be configured to include at least one fluid reservoir interconnected by a valved conduit to deliver an amount of fluid from at least one reservoir to the mouth of a user. However, it is believed that no prior attempt has been made to configure a pillow to include or retain a fluid delivery system.

There would be a substantial advantage in a pillow and a fluid delivery system configured as a combination by which a user can deliver a fluid from the fluid delivery system contained in or retained by a pillow to the mouth of a user.

II. SUMMARY OF THE INVENTION

Accordingly, a broad object of particular embodiments of the invention can be to provide a combination of a pillow and fluid delivery system which delivers a fluid from the fluid delivery system contained in or retained by a pillow to the mouth of a user.

Another broad object of particular embodiments of the invention can be a method of making a combination of a pillow and fluid delivery system which delivers a fluid from the fluid delivery system contained in or retained by a pillow to the mouth of a user.

Another broad object of embodiments the invention can be a method of using a combination of a pillow and fluid delivery system which delivers a fluid from the fluid delivery system contained in or retained by a pillow to the mouth of a user.

Naturally, further objects of the invention are disclosed throughout other areas of the specification, drawings, photographs, and claims.

III. A BRIEF DESCRIPTION OF THE DRAWINGS

IV. DETAILED DESCRIPTION OF THE PREFERRED EMBODIMENTS

Now referring generally to FIGS. 1 through 15, embodiments of an inventive pillow (1) configured to receive or retain a fluid delivery system (2).

Figure 2A:
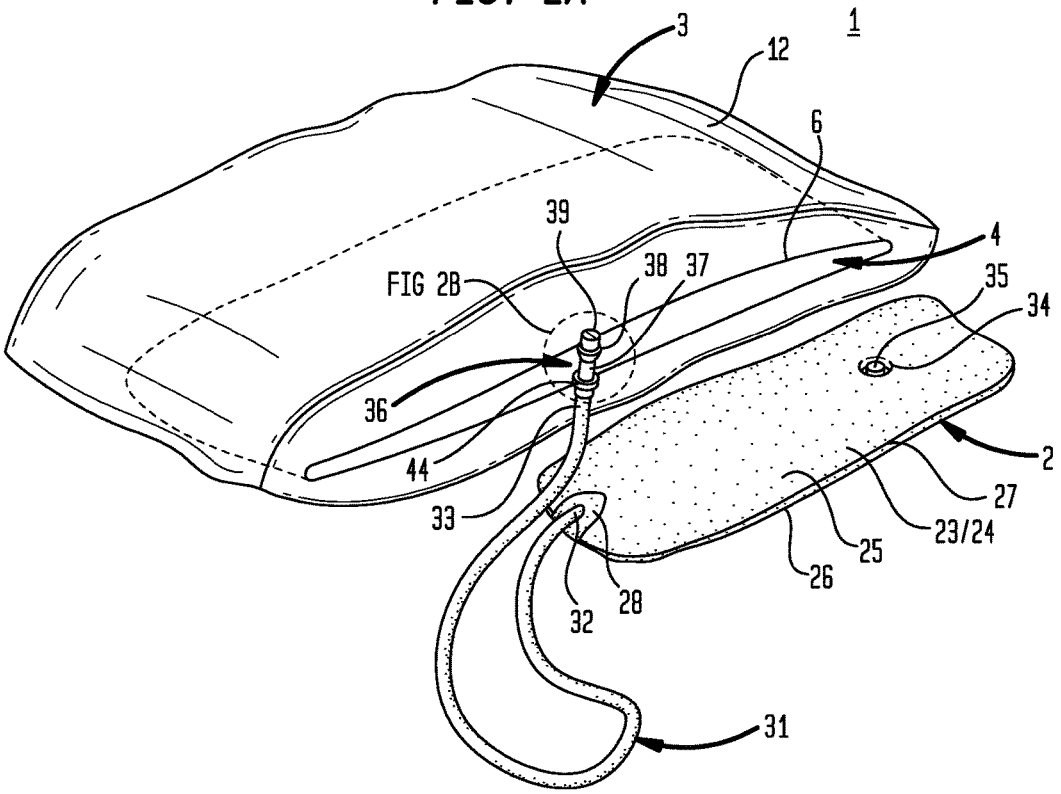
FIG. 2A is an illustration of a particular embodiment of an inventive pillow body having a pillow pocket configured to receive a particular embodiment of a fluid delivery system.
Figure 5:
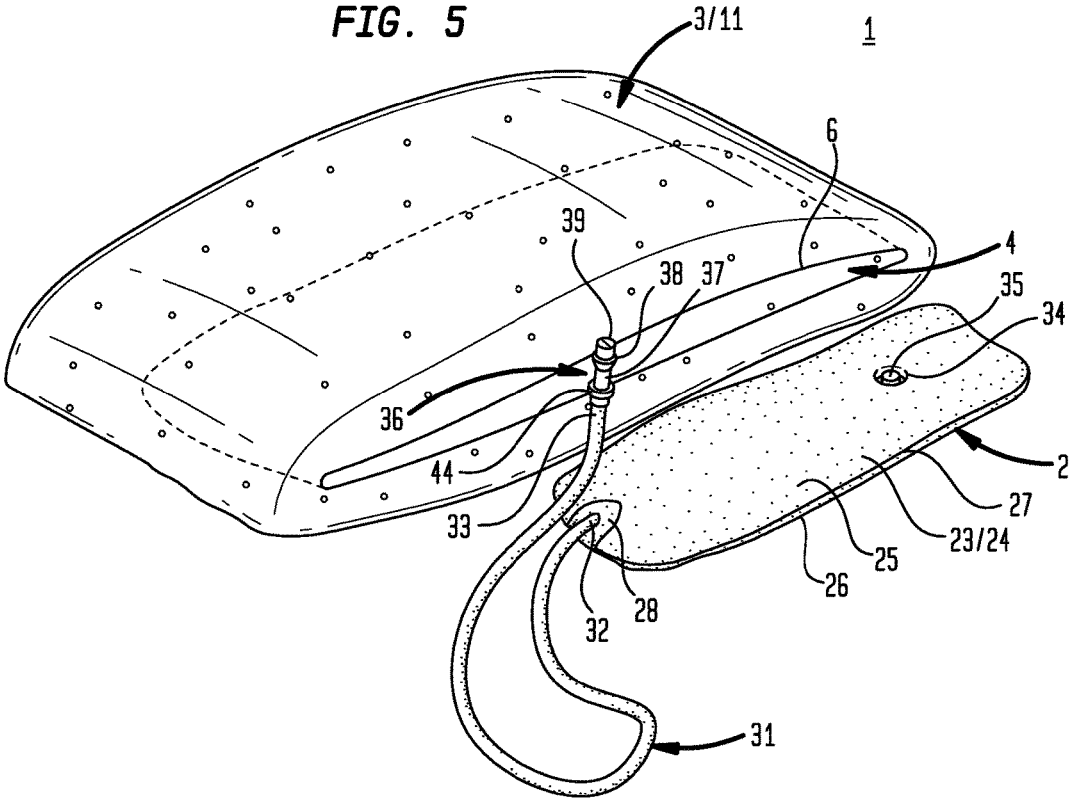
FIG. 5 is an illustration of a particular embodiment of an inventive pillow body having a pillow pocket configured to receive a fluid delivery system formed as one piece.
Figure 6:
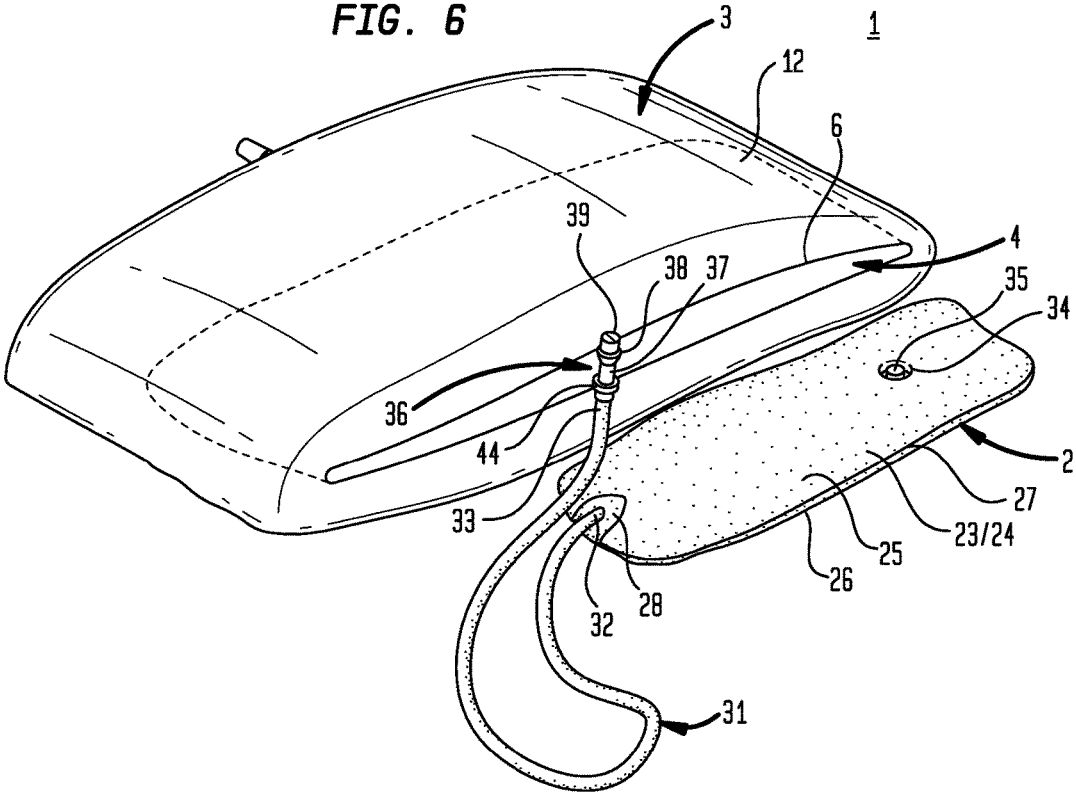
FIG. 6 is an illustration of a particular embodiment of an inventive pillow body having a pillow pocket configured to receive a fluid delivery system including an outer case configured to releasably contain an amount of gas.
Figure 7:
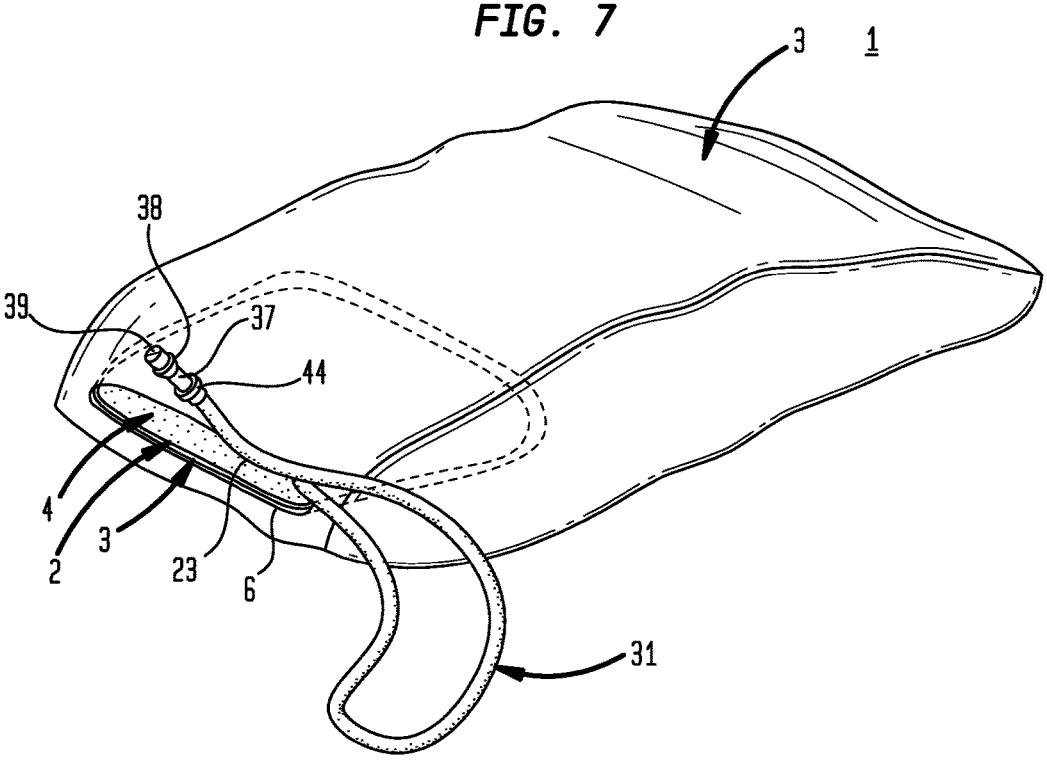
FIG. 7 is an illustration of a particular embodiment of an inventive pillow body having a pillow pocket configured to receive a fluid delivery system disposed in a pillow body first end.
Figure 8:
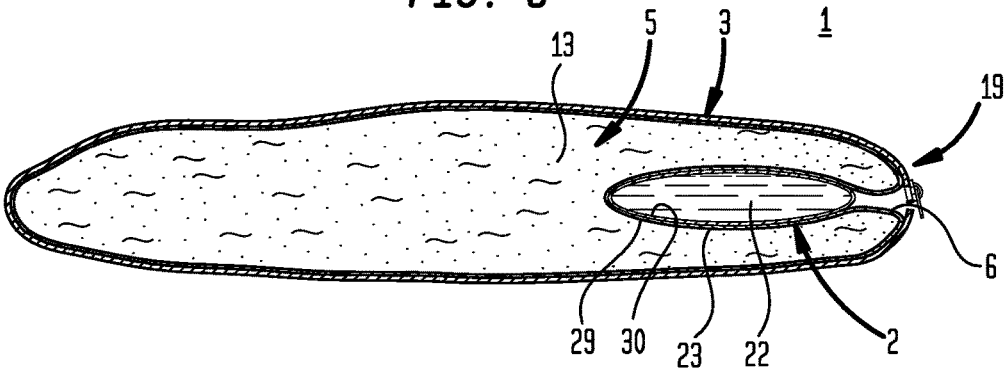
FIG. 8 is a cross section view 8-8 shown in FIG. 4 of the inventive pillow body having disposed within a fluid delivery system.
Figure 9:
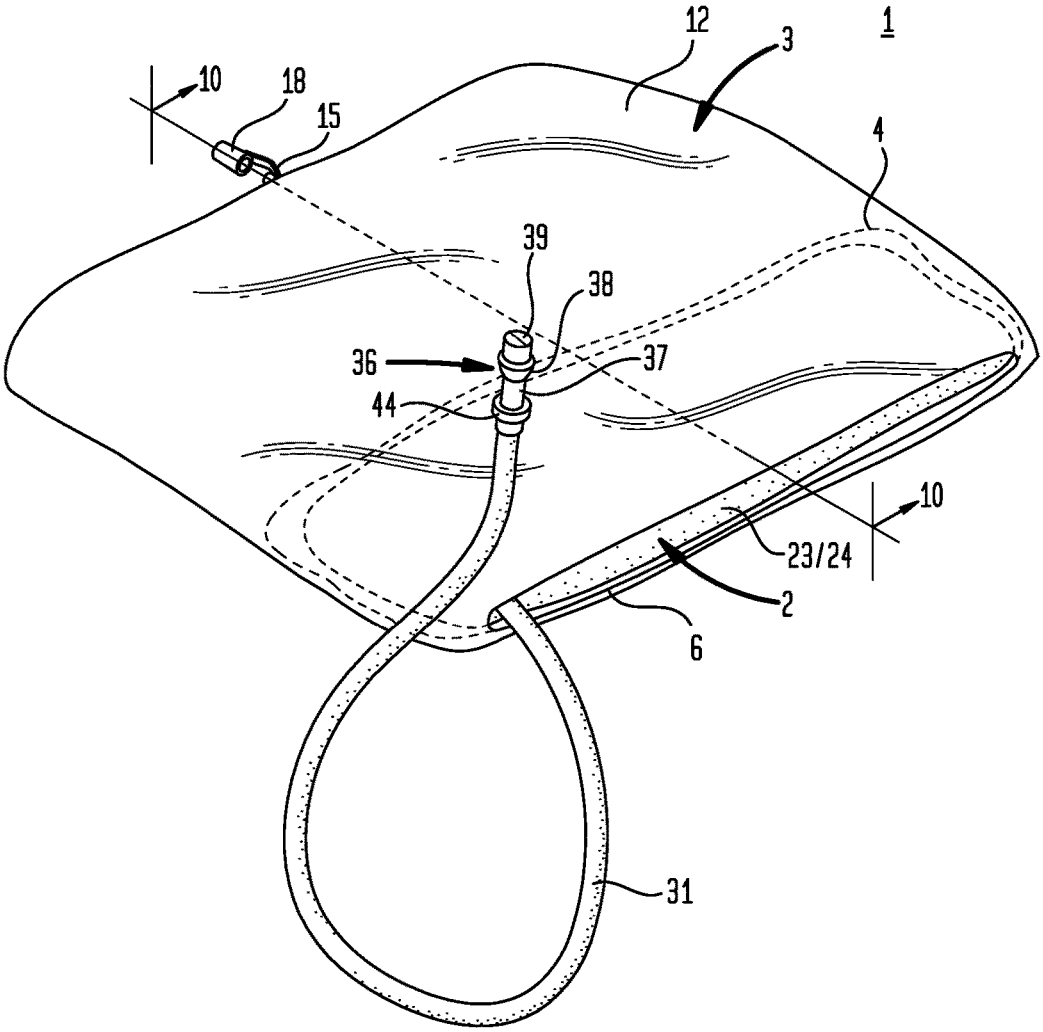
FIG. 9 is an illustration of a particular embodiment of the inventive pillow body having a pillow pocket communicating with a pillow body first end having disposed within a fluid delivery system.
Figure 10:
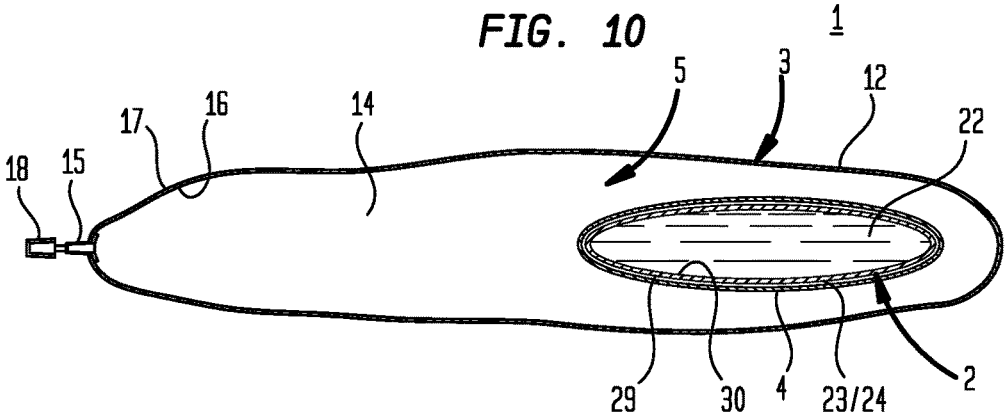
FIG. 10 is a cross section view 10-10 of the particular embodiment of the inventive pillow of FIG. 9.
Figure 11:
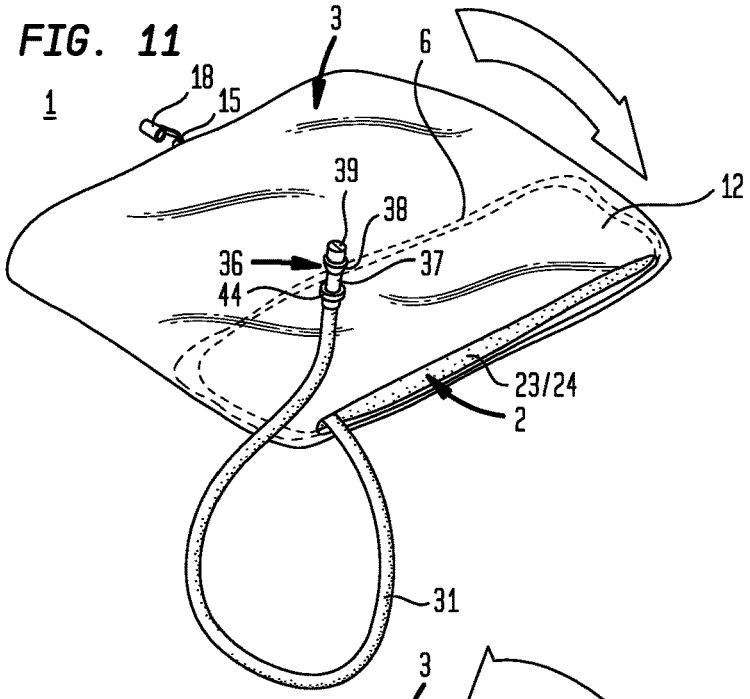
FIG. 11 is an illustration of a method of generating a first fold in the pillow shown in FIG. 9 to reduce the volume of the combination of the pillow and reservoir fluid delivery system.
Figure 12:
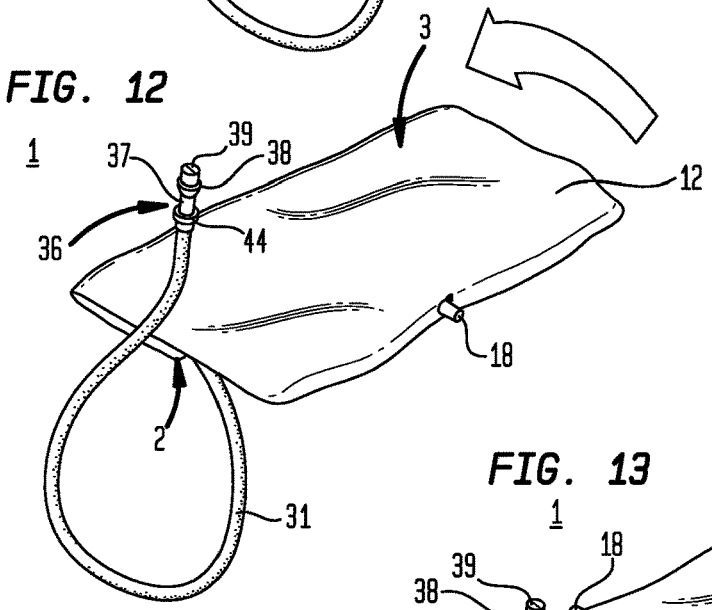
FIG. 12 is an illustration of a method of generating a second fold in the pillow shown in FIG. 11 reduce the volume of the combination of the pillow and reservoir fluid delivery system shown.
Figure 13:
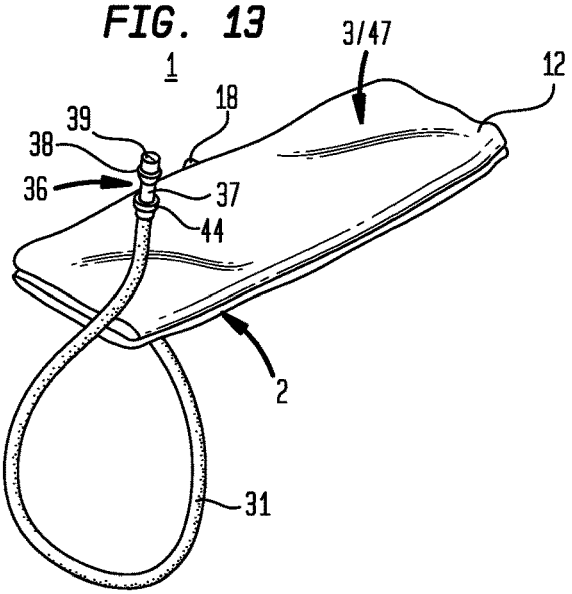
FIG. 13 is an illustration of a method of producing a reduced volume configuration of the combination of the pillow and reservoir fluid delivery system shown in FIG. 9.

Now referring primarily to FIGS. 2 through 7, embodiments of the inventive pillow (1) include a pillow body (3) having a pillow pocket (4) which traverses the interior volume (5) of the pillow (1) defining a pillow pocket opening (6) communicating with the external surface (7) of the pillow (1) (as shown in the examples of FIGS. 2A, 5, and 6). The pillow pocket (4) and the pillow pocket opening (6) can be adapted for removably receiving the fluid delivery system (2).

The pillow body (3) having the pillow pocket (4) which traverses the interior volume (5) can be formed or made from a wide variety of soft or deformable materials suitable for cushioning the body of a user (8), or a part thereof, such as a user's head (9) or a user's neck (10). As to particular embodiments, the pillow body (3) having the pillow pocket (4) can, but need not necessarily, be integrally formed in as a one piece pillow body (11) including the pillow pocket (4) with a foam material, such as either an open-cell or closed-cell foam, memory foam, or the like (as shown in the example of FIG. 5). In such embodiments, the one piece pillow body (11) can, but need not necessarily, further include a flexible covering (12) which surrounds the one piece pillow body (11).

Other embodiments the pillow body (2) having the pillow pocket (4) can, but need not necessarily, include a flexible covering (12) having a pillow pocket (4) which traverses the interior volume (5) of the flexible covering (12). An amount of fill material (13), such as polyester filling, bamboo fibers, feathers, down, or the like, or combinations thereof, can be disposed within the flexible covering (12) (as shown in the example of FIG. 2A). In such embodiments, the flexible covering (12) can be, but need not necessarily, be made of a woven or non-woven flexible fabric made with natural fibers such as silk, cotton, wool, jute, or the like or synthetic fibers such as polyvinylchloride, polypropylene, acrylic, nylon, rayon, or the like, or a combination thereof. The flexible covering (12) can, but need not necessarily be, substantially impermeable to liquids.

As to other embodiments, the pillow body (3) having the pillow pocket (4) can, but need not necessarily, include a flexible covering (12) having a pillow pocket (4) which traverses the interior volume (5) of the flexible covering (12). The flexible covering (12) can be adapted to releasably retain an amount of gas (14) such as a purified gases or a mixture of gases such as air (as shown in the example of FIG. 6). Such embodiments, can, but need not necessarily, include a pillow port (15) which communicates between the internal surface (16) and the external surface (17) of the flexible covering (12). The pillow port (15) can be releasably sealed by a corresponding pillow port closure (18). The pillow port closure (18) can function to allow the flexible covering (12) to be opened and an amount of gas (14) delivered to or released from interior volume (5) defined by the internal surface (16) of the flexible covering (12) and can be closed to contain the amount of gas (14) within the flexible cover (12). Certain embodiments of the pillow port closure (18) can be releasably sealably engaged by mated spiral threads; however, the invention is not so limited, and a pillow port closure (18) can releasably sealably engage with the pillow port (15) by any configuration of sealing surfaces which sufficiently seal to contain the amount gas (14) inside the flexible covering (12) during normal use. In such embodiments, the flexible covering (12) adapted to retain an amount of gas (14) can be, but need not necessarily, be made of a non-woven flexible fabric made with, as illustrative examples: polyvinylchloride, polypropylene, acrylic, nylon, or the like, or a combinations thereof.

Figure 1:
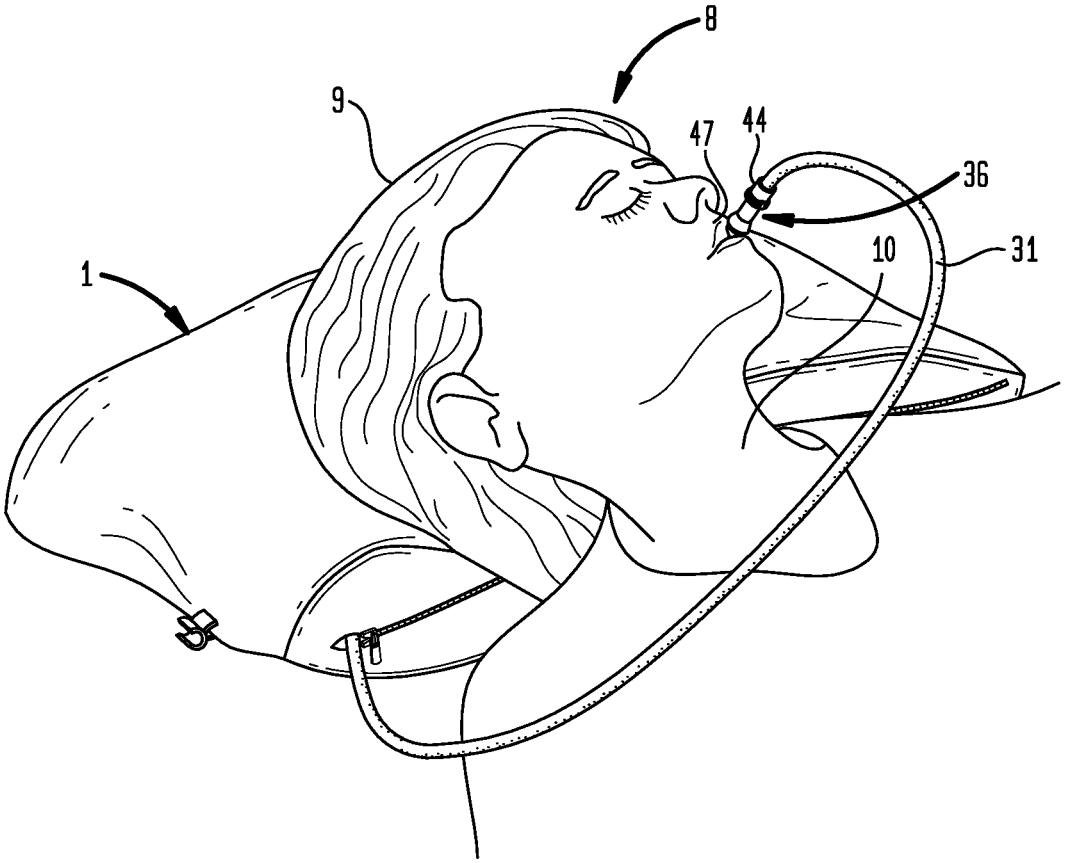
FIG. 1 is an illustration of a particular method of using a particular embodiment of the inventive pillow having a fluid delivery system.
Figure 14:
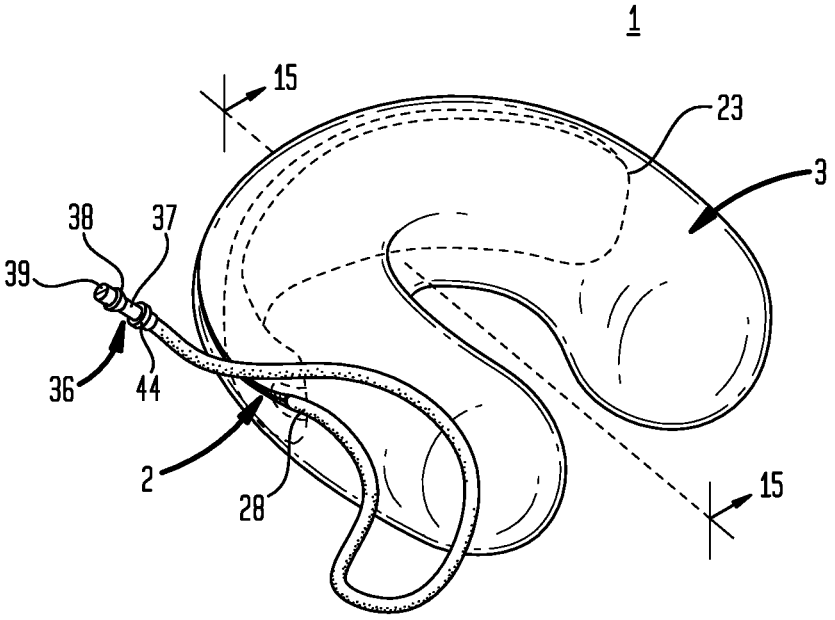
FIG. 14 is an illustration of another particular embodiment of the inventive pillow body having a pillow pocket adapted to position around the neck of a user having disposed within the pillow pocket a fluid delivery system.

The external surface (17) of the pillow body (3) can have a numerous and wide variety of configurations depending on the application. The external surface (17) of the pillow body (3) can, but need not necessarily, be configured in the form of a pillow (1) adapted to support the head (9) of a user (8) (as shown in the example of FIG. 1) or can, but need not necessarily, be configured to be disposed about the neck (10) of a user (8) (as shown in the example of FIG. 14).

Embodiments can, but need not necessarily, include an outer case (19) having an outer case opening (20) or through which the pillow body (3) can be removably inserted into an outer case interior volume (21). The outer case (19) can, but need not necessarily, be made using woven or non-woven fabrics, including as illustrative examples: natural fibers such as silk, cotton, wool, jute, or the like or synthetic fibers such as polyvinylchloride, polypropylene, acrylic, nylon, rayon, or the like, or a combination thereof.

The fluid delivery system (2) in combination with the pillow (1) can be useful for delivering an amount of fluid (22) for hydration of a user (8). The fluid delivery system (2) can, but need not necessarily, be configured to be utilized by a user (8) discrete from the pillow (2) to facilitate transport, storage, or a particular use by the user (8). As to those particular embodiments, the fluid delivery system (2) can be removably disposed inside the pillow (1) (as shown in the example of FIGS. 2 through 9); however, as to other embodiments, the fluid delivery system (2) can be disposed within the pillow (1) or otherwise attached to the pillow (1) such that the fluid delivery system (2) and the pillow (1) cannot be separated or used separately (as shown in the example FIGS. 9 through 13).

Again referring primarily to FIGS. 1 through 15, embodiments of the fluid delivery system (2) include at least one fluid reservoir (23) adapted to contain an amount of fluid (22). While embodiments shown in the Figures include only one fluid reservoir (23), this it is not intended to preclude embodiments that contain two or more fluid reservoirs (23) whether as discrete reservoirs or fluidicly coupled to allow delivery of an amount of fluid (22) selectively from a first reservoir or second fluid reservoir or both. Each fluid reservoir (23) can be made from a flexible material (24) which can, but need not necessarily, include resilient or elastic properties.

Embodiments of the fluid reservoir (23) can be made from a variety of materials, including as illustrative examples: polyvinylchloride, a mixture of polyester and polyvinylchloride, a mixture of polyvinylchloride and thermoplastic urethane, or the like, or combinations thereof, and can further include reinforcement fibers within the flexible material (24) or between layers of the flexible material (24) for additional strength. As to particular embodiments, the fluid reservoir (23) can each be produced from a first layer (25) and a second layer (26) of flexible material (24) joined proximate the fluid reservoir periphery (27) (as shown in the examples of FIGS. 2, 3, 5, and 6). The first layer (25) and the second layer (26) of flexible material (24) can for example be joined proximate the fluid reservoir periphery (27) by adhesive, heat sealing, or the like, or a combinations thereof; however, it is not intended that this description preclude embodiments formed as an integral one piece fluid reservoir (23) formed about a mold, or otherwise. The one or more reservoirs (23) can be provided in numerous and varied shapes, sizes, and volumes depending upon the configuration of the pillow (1), the pillow pocket (4), the amount of fluid (22) to be contained in the fluid reservoir (23), the number reservoirs, the application or the like.

Again referring primarily to FIGS. 2 through 15, embodiments of the fluid delivery system (2) can, but need not necessarily, include a reservoir first port (28) coupled the fluid reservoir (23). The reservoir first port (28) communicates between an external surface (29) and an internal surface (30) of the fluid reservoir (23). A fluid conveying conduit (31) having a length disposed between a conduit first end (32) and a conduit second end (33) can be coupled by the conduit first end (33) to the reservoir first port (28). Certain embodiments of the fluid conveying conduit (31) can be in the form of a flexible conduit, in whole or in part, or can be in the form of substantially rigid conduit such that the term "fluid conveying conduit (31)" encompasses any constructional form of conduit useful in practicing embodiments of the invention. The fluid conveying conduit (31) can be fabricated or molded from various materials compatible with carrying a flow of fluid (22) for consumption by the user (8), such as cross-linked polyethylene, polyurethane, vinyl, or the like.

Again referring primarily to FIGS. 2, 3, 5, and 6 the fluid reservoir (23) can, but need not necessarily, include a reservoir second port (34). The reservoir second port (34) communicates between an external surface (29) and an internal surface (30) of the fluid reservoir (23). The reservoir second port (34) can be releasably sealed by a corresponding second port closure (35). The second port closure (35) can function to allow the fluid reservoir (23) to be opened to empty, fill, or clean and to be closed to contain an amount of fluid (22) within the fluid reservoir (23). Certain embodiments of the second port closure (35) can, but need not necessarily, be releasably sealably engaged with the reservoir second port (34) by mated spiral threads; however, the invention is not so limited, and the second port closure (35) can releasably sealably engage with the reservoir second port (34) by any configuration of sealing surfaces which sufficiently seal to contain the amount fluid (22) inside the fluid reservoir (23) during normal use. Additionally, while the reservoir second port (34) and the respective second port closure (35) are shown as being substantially circular; the invention is not so limited and the reservoir second port (34) can be provided in any configuration sealable by a correspondingly mateable second port closure (35).

The amount of fluid (22) contained in the fluid delivery system (2) can be any fluid useful in hydration of the user (8), including as illustrative examples, one or more of: an amount of an amount of liquid, water, a beverage, a juice, a sports drink, an energy drink, or the like, or combinations thereof. For the purposes of this invention the term "hydration" means maintaining bodily fluid balance of a user (8) by intake of an amount of fluid (22). The term "user" for the purposes of this invention means one or more persons capable of using an embodiment of the fluid delivery system (2) whether discrete from or in combination with configurations of the pillow (1).

As to particular embodiments, the conduit second end (33) can be adapted to be received by the mouth (47) of the user (8). As to other embodiments, a mouthpiece (36) can, but need not necessarily, be connected to the conduit second end (33). The mouthpiece (36) can be adapted to be received by the mouth (47) of the user (8). The user (8) can draw upon the conduit second end (33) or the mouthpiece (36) to generate a flow of the amount of fluid (22) from a corresponding fluid reservoir (23).

Figure 2B:
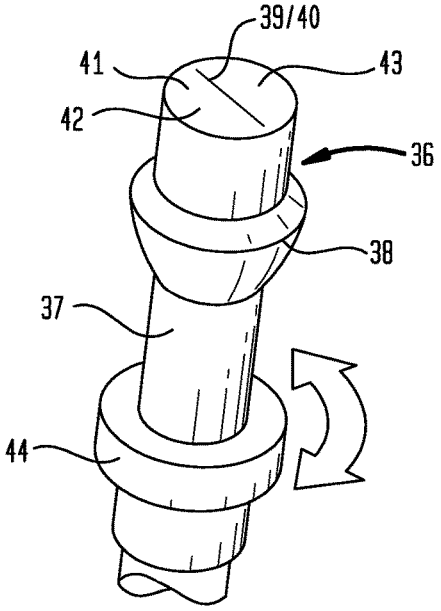
FIG. 2B is an illustration of a particular embodiment of a mouthpiece that can be utilized with embodiments of the fluid delivery system.
Figure 3:
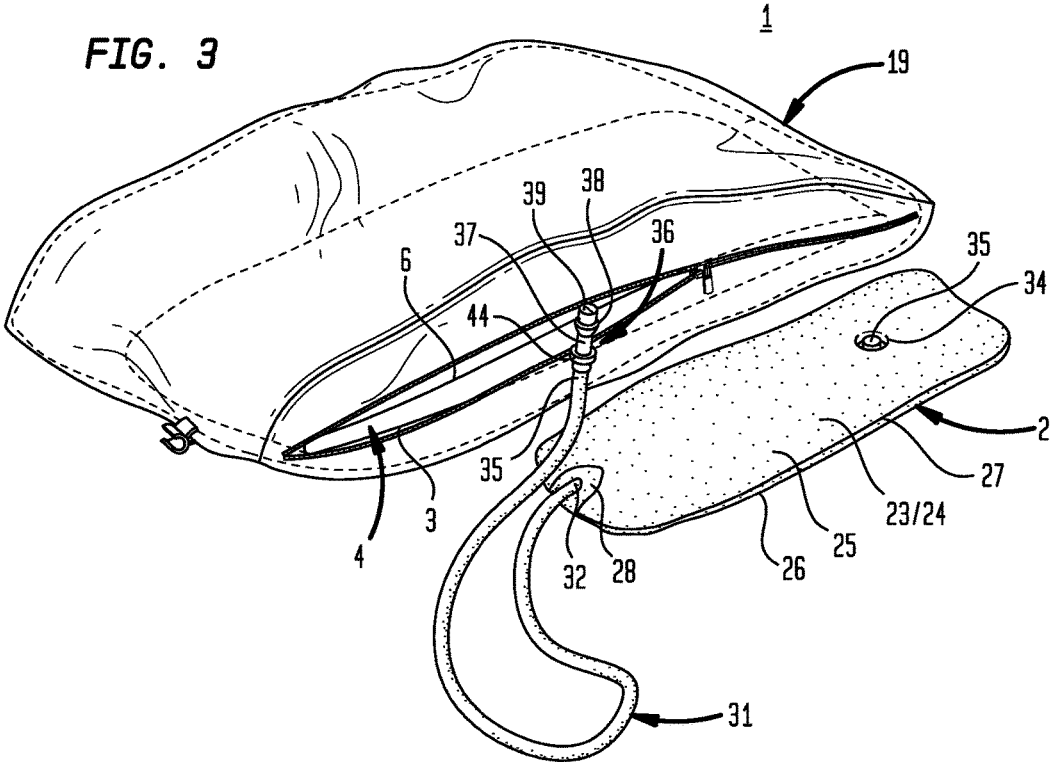
FIG. 3 is an illustration of an outer case disposed about the pillow body shown in FIG. 2.
Figure 4:
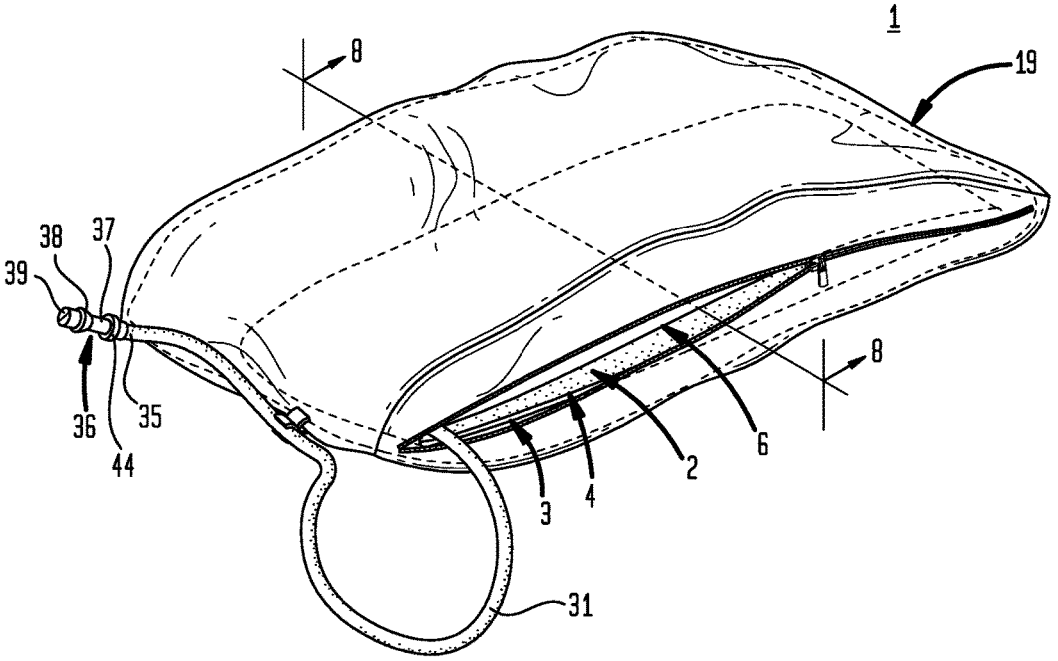
FIG. 4 is an illustration of inventive pillow of FIG. 3 having the fluid delivery system disposed inside of the pillow pocket disposed in the pillow body.

Now referring primarily to FIG. 2B, certain embodiments of the mouthpiece (36) can, but need not necessarily, include a neck portion (37) and a head portion (38). The head portion (38) can, but need not necessarily, be of larger cross-section than the neck portion (37). As to particular embodiments, the head portion (38) of the mouth piece (36) can be formed from a resilient deformable material such that a normally closed fluid dispensing orifice (39) can be opened by defaulting the head portion (38). As to certain embodiments, the normally closed dispensing orifice (39) can be in the form of a slit (40) having a location on a fluid dispensing face (41) of the head portion (38) of the mouthpiece (36). The slit (40) can have opposed side walls (42)(43) which sealably engage until sufficient deformation of the head portion (38) of the mouth piece (36) spreads the side walls (42)(43) a distance apart to allow passage of an amount of fluid (22) from the fluid reservoir (23) through the mouthpiece (36).

Now referring to FIG. 1, as to certain embodiments, a valve (44) can be coupled to the medial portion of the fluid conveying conduit (31) or to the mouthpiece (36). The valve (44) can be operable to allow the flow or interrupt the flow of the fluid (22) from the fluid reservoir (23).

Now referring primarily to FIGS. 2 through 8, showing an illustrative example of the inventive pillow (1) include a pillow body (3) having a pillow pocket (4) (shown in broken line) which traverses the interior volume (5) of the pillow (1) defining a pocket opening (6) disposed on the external surface (7) of the pillow (1) along a pillow first side (45) or pillow first end (46). The pillow pocket (4) can removably receive a discrete fluid delivery system (2) with a portion of the fluid conveying conduit (31) extending outside of the pillow pocket (4) disposing the conduit second end (33) or mouthpiece (36) at a location outside of the pillow body (3) at a location at which the which a user (8) can draw on to deliver an amount of fluid (22) contained in the fluid reservoir (23) to the mouth (47) of the user (8) (as show in the example of FIG. 1).

Figure 15:
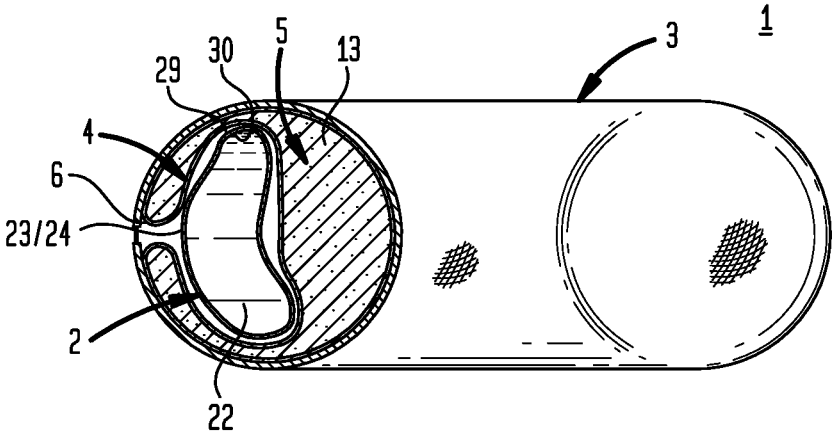
FIG. 15 is a cross section view 15-15 of the particular embodiment of the pillow having disposed within a fluid delivery system of FIG. 14.

Now referring primarily to FIGS. 14 and 15 showing an illustrative example of the inventive pillow (1) including a pillow body (3) having an external surface (7) having configuration to dispose about the neck (10) of the user (8). The pillow body (3) having a pillow pocket (4) (shown in broken line) which traverses the interior volume (5) of the pillow (1) defines a pillow pocket opening (6) communicating with the external surface (7) of the pillow (1) at a location distal from the portion of the external surface (7) configured to engage the neck (10) of the user (8). The pillow pocket (4) can removably receive a discrete fluid delivery system (2) with a portion of the fluid conveying conduit (31) passing through the pillow pocket (6) and extending outside of the pillow body (3) to dispose the conduit second end (33) or mouthpiece (36) at a location at which the mouth (47) of the user (8) can engage the conduit second end (33) or mouthpiece (36). The user (8) can draw upon the conduit second end (33) or the mouthpiece (36) to deliver an amount of fluid (22) contained in the fluid reservoir (23) to the mouth (47) of the user (8) (as shown in the example of FIG. 1).

Now referring primarily to FIGS. 9 through 13 showing an illustrative example of the inventive pillow (1) include a pillow body (3) having flexible covering (12) having a pillow pocket (4) (shown in broken line) which traverses the interior volume (5) of the pillow (1) defining a pocket opening (6) communicating with the external surface (17) of the pillow (1). The flexible covering (12) can be releasably sealed to correspondingly releasably contain an amount of gas (14). The pillow (1) can have a reduced volume configuration (47) when the amount of gas (14) contained in the flexible covering (12) is released and the flexible covering (12) is folded upon itself. The pillow pocket (4) can removably receive or be fixedly joined to a fluid delivery system (2) with a portion of the fluid conveying conduit (31) extending outside of the pillow body (3) to dispose the conduit second end (33) or mouthpiece (36) at a location at which the mouth (47) of the user (8) can engage the conduit second end (33) or mouthpiece (36). The user (8) can draw upon the conduit second end (33) or the mouthpiece (36) to deliver an amount of fluid (22) contained in the fluid reservoir (23) to the mouth (47) of the user (8) (as shown in the example of FIG. 1).

As can be easily understood from the foregoing, the basic concepts of the present invention may be embodied in a variety of ways. The invention involves numerous and varied embodiments of an inventive pillow having a fluid delivery system and methods of using the inventive pillow having a fluid delivery system.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of "a closure" should be understood to encompass disclosure of the act of "closing"—whether explicitly discussed or not—and, conversely, were there effectively disclosure of the act of "closing", such a disclosure should be understood to encompass disclosure of "a closure" and even a "means for closing." Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

Moreover, for the purposes of the present invention, the term "a" or "an" entity refers to one or more of that entity; for example, "a light source" refers to one or more of those light sources. As such, the terms "a" or "an", "one or more" and "at least one" can be used interchangeably herein.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment.

Thus, the applicant(s) should be understood to claim at least: i) a pillow having fluid delivery system as herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

The claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

We claim:

1. A pillow, comprising:

a pillow body including a flexible cover defining an interior space;

a pillow pocket traversing said interior space of, said pillow pocket having a pillow pocket opening communicating with an external surface of said flexible cover;

a fill material contained in said interior space;

a fluid reservoir removably disposed in said pillow pocket;

a first reservoir port communicating between an internal surface and an external surface of said fluid reservoir;

a fluid conveying conduit having a fluid conveying conduit first end connected to said first reservoir port, said fluid conveying conduit passing through said pillow pocket opening of said flexible cover; and a second reservoir port communicating between said internal surface and said external surface of said fluid reservoir releasably sealed with a port closure.

2. The pillow of claim 1, further comprising:

a pillow port which communicates between an internal surface and an external surface of said flexible cover; and a pillow port closure configured to releasably sealably engage said pillow port, wherein said amount of fill material comprises an amount of gas.

3. The pillow of claim 1, further comprising a mouthpiece connected to said fluid conveying conduit second end.

4. The pillow of claim 1, further comprising a valve coupled to said fluid conveying conduit, said valve operable to regulate flow of an amount of fluid from said fluid reservoir toward said fluid conveying conduit second end.

5. The pillow of claim 1, wherein said amount of fill material comprises one or more of a foam material, a polyester filling, bamboo fibers, feathers, down, or combinations thereof.

6. The pillow of claim 1, wherein said fluid reservoir removable from inside of said pillow pocket of said flexible cover.

7. The pillow of claim 1, wherein said fluid reservoir remains fixedly disposed inside of said pillow pocket of said flexible cover.

8. The pillow of claim 1, wherein said flexible cover and said pillow pocket comprises a one-piece flexible cover and pillow pocket.

9. A method in a pillow, comprising:

configuring a flexible cover to define an interior space of said pillow;

traversing said interior space with a pillow pocket, said pillow pocket having a pillow pocket opening communicating with an external surface of said flexible cover;

disposing an amount of fill material inside of said interior space of said flexible cover;

removably disposing a fluid reservoir in said pillow pocket, said fluid reservoir including:

a first reservoir port communicating between an internal surface and an external surface of said fluid reservoir;

a second reservoir port communicating between said internal surface and said external surface of said fluid reservoir, said second reservoir port releasably sealed with a port closure;

connecting a fluid conveying conduit by a fluid conveying conduit first end to said first reservoir port, said fluid conveying conduit passing though said pillow pocket opening of said flexible cover.

10. The method of claim 9, further comprising:

coupling a pillow port to said flexible cover, said pillow port communicating between an internal surface and an external surface of said flexible cover; and releasably sealably engaging said pillow port with a pillow port closure to allow releasable retention of an amount of gas inside of said flexible cover.

11. The method of claim 9, wherein said amount of fill material comprises one or more of a foam material, a polyester filling, bamboo fibers, feathers, down, or combinations thereof.

12. The method of claim 9, further comprising producing said flexible cover and said pillow pocket in one piece.

13. The method of claim 9, further comprising fixedly disposing said fluid reservoir inside of said pillow pocket of said flexible cover.

14. The method of claim 9, further comprising connecting a mouthpiece to said fluid conveying conduit second end.

15. The method of claim 9, further comprising coupling a valve to said fluid conveying conduit, said valve operable to regulate flow of an amount of fluid from said fluid reservoir toward said fluid conveying conduit second end.

* * * * *